United States Patent [19]

Saperstein et al.

[11] 4,373,578

[45] Feb. 15, 1983

[54] RADIATOR WITH HEAT EXCHANGER

[75] Inventors: Zalman P. Saperstein, Gurnee, Ill.; Refki M. El-Bourini, West Allis; John E. Munch, Jr., Racine, both of Wis.

[73] Assignee: Modine Manufacturing Company, Racine, Wis.

[21] Appl. No.: 257,223

[22] Filed: Apr. 23, 1981

[51] Int. Cl.[3] ..... F28D 7/10

[52] U.S. Cl. ..... 165/141; 165/155; 165/156; 165/179; 165/DIG. 23

[58] Field of Search ..... 165/140, 141, 154, 155, 165/156, DIG. 23, 179; 184/104 B

[56] References Cited

U.S. PATENT DOCUMENTS

| | | | |
|---|---|---|---|
| 1,983,466 | 12/1934 | Kline | 165/178 |
| 2,847,193 | 8/1958 | Carter | 165/156 |
| 3,200,848 | 8/1965 | Takagi | 165/179 |
| 3,473,348 | 10/1969 | Bottum | 165/179 |
| 4,004,634 | 1/1977 | Habdas | 165/141 |

FOREIGN PATENT DOCUMENTS

| | | | |
|---|---|---|---|
| 881258 | 4/1943 | France | 165/179 |
| 911987 | 9/1960 | United Kingdom | 165/179 |

*Primary Examiner*—William R. Cline
*Assistant Examiner*—John F. McNally
*Attorney, Agent, or Firm*—Wegner, McCord, Wood & Dalton

[57] ABSTRACT

A cooling radiator having a secondary cooling means and comprising a pair of spaced liquid coolant tanks, one of which is an inlet tank having a liquid coolant inlet adjacent one end and the other of which is a liquid outlet tank having an outlet adjacent its corresponding opposite end, interconnecting spaced coolant tubes between the tanks, a heat exchanger for cooling a second liquid such as engine oil located in the outlet tank with the heat exchanger having a spaced inlet and outlet and a confined liquid space therebetween for flow of this second liquid through this spaced and an internal fin within the heat exchanger located within an inner tube of the heat exchanger in heat exchange relationship with the liquid coolant in the outlet tank.

2 Claims, 7 Drawing Figures

LIQ. IN
19
10
16
13
11
15
23
18
2.
12
14
OIL IN
28
24
29
OIL OUT
2.
LIQ. OUT
17
13
22

42
12
28
OIL IN
24
27
3.
3.
26
25
29
OIL OUT
33

26
25
36
34
27
36
35
33
4.
4.
24
32
39

5.
38
26
36
5.

38
37
36
38
37

RADIATOR WITH HEAT EXCHANGER

BACKGROUND OF THE INVENTION

Cooling radiators of the type used for air cooling the liquid coolant of internal combustion engines are well known and widely used. These engines also employ lubricating oil for lubricating the engine and the heat that is accumulated by this oil is customarily dissipated by conveying the oil through an oil cooler. The present invention provides an improved oil cooler with an exchanger in heat exchange relationship with the liquid coolant and the radiator in which the exchanger is positioned in the outlet tank of the radiator and is provided with an inner tube within which is located an internal fin in heat exchange relationship with the liquid in the radiator outlet tank that is directed through this tube and in contact with the internal fin.

The most pertinent prior art of which Applicants are aware are the following U.S. Pat. Nos.: Yeager 2,054,403, Dedo 2,752,128, Coraggioso 3,071,159, Takagi 3,200,848, Toland 3,232,283, Burne et al. 3,323,586, Huggins 3,486,489, Hunt 3,487,215 and Hilicki et al. 3,732,921, none of which disclose the invention.

BRIEF DESCRIPTION OF THE PREFERRED EMBODIMENTS

Figure 1:
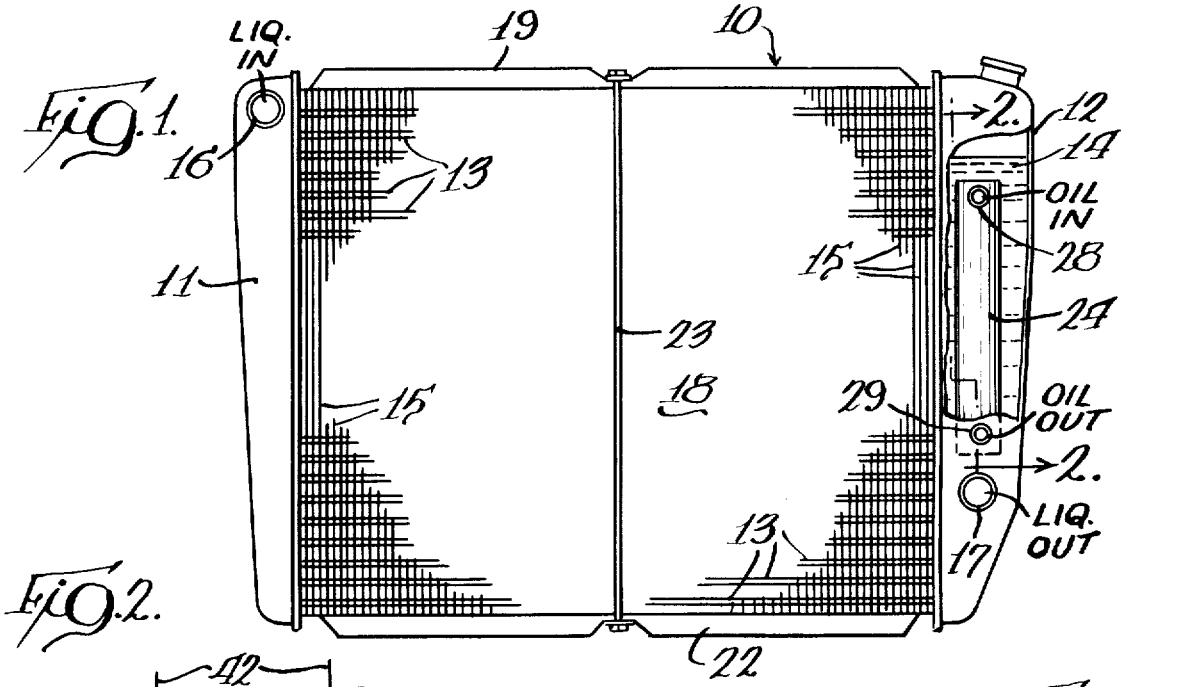
FIG. 1 is a side elevational view partially broken away of the cooling radiator embodying the invention.
Figure 2:
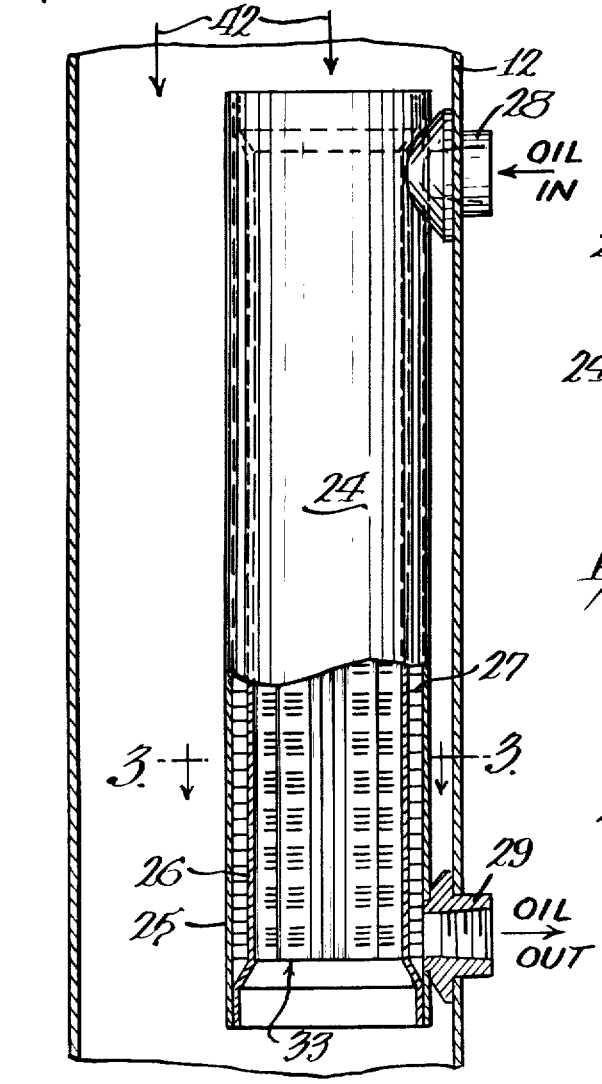
FIG. 2 is an enlarged vertical sectional view also partially broken away taken along line 2—2 of FIG. 1.
Figure 3:
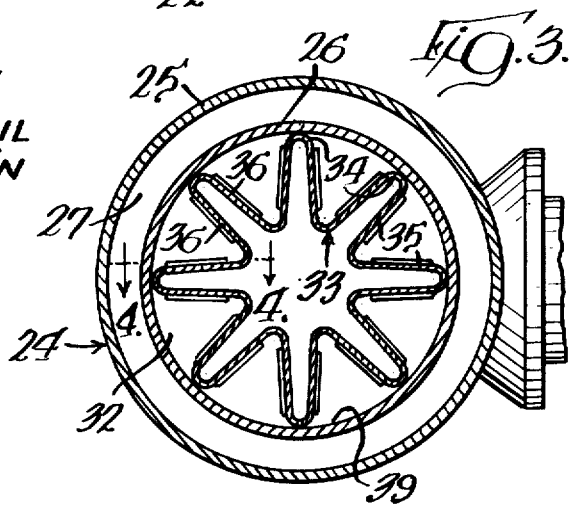
FIG. 3 is a sectional view taken along line 3—3 of FIG. 2.
Figure 4:
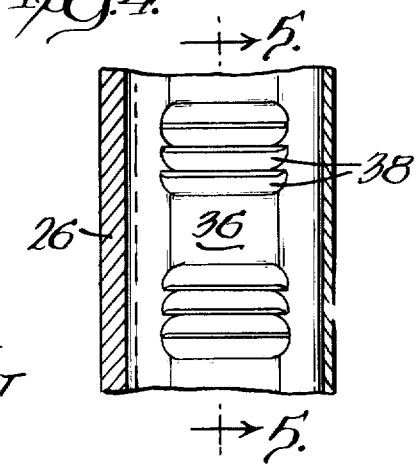
FIG. 4 is an enlarged sectional view taken along line 4—4 of FIG. 3.

In the embodiment of FIGS. 1-5, the radiator 10 comprises a pair of spaced vertical tanks 11 and 12 interconnected by spaced parallel tubes 13 for conveying a liquid coolant such as water 14 between the tanks. The tubes 13 themselves are interconnected by spaced transverse metal fins 15.

The tank 11 functions as a liquid inlet tank and is provided with an inlet fitting 16 adjacent one end, here the top end. The opposite tank 12 functions as an outlet tank and is provided with a similar but outlet fitting 17 at the corresponding opposite end, here the lower end, of this tank. The top and bottom of the core 18 of the radiator comprising the tubes 13 and fins 15 are provided with braces 19 and 22 clamped together by means of opposite tie rods 23.

Located within the outlet tank 12 is a heat exchanger 24 for cooling secondary liquid such as engine lubricating oil. This heat exchanger 24 is in heat exchange relationship with the coolant 14 in the outlet tank 12 and comprises concentric cylinders 25 and 26 spaced apart as illustrated to provide a confined space 27 that extends almost the entire length of heat exchanger 24 as illustrated most clearly in FIG. 2. This space 27 is provided with an inlet fitting 28 adjacent to one end, here the upper end of the vertical exchanger 24, and an outlet fitting 29 adjacent the opposite or lower end of the heat exchanger.

Figure 5:
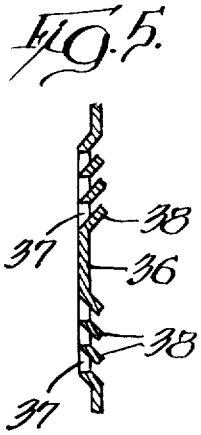
FIG. 5 is a sectional view taken along line 5—5 of FIG. 4.

Located within the interior 32 of the inner cylinder 26 is an internal fin 33 which is shown in this embodiment as a sheet metal fin arranged in a star shape with the tips of the star bearing against the inner surface 39 of the inner cylinder 26. These tips 34 each comprise the outer extremities of spaced fingers 35 comprising the star. The opposite sides 36 of each finger 35 are apertured in the form of elongated slots 37 and fluted with flanges 38 on opposite sides of each slot 37. The flanges 38 are distorted out of the plane of the metal sides 36 as shown in FIG. 5. The result is that these apertures and flutes create turbulence in the liquid coolant, such as water 14, flowing through the slots 37 and directs the flowing water illustrated by the arrows 42 over the surfaces of the spaced fingers 35.

The heat exchanger or oil cooler in the illustrated embodiment, because of the provision of the fin 33, provide very efficient heat transfer between the oil flowing through space 27 and the liquid coolant 14 so that the heat exchanger 24 can be relatively compact while still providing large cooling capacity.

As can be seen in FIG. 1, the outlet fitting 29 for the heat exchanger or oil cooler 24 is located adjacent to a coolant outlet 17 from the radiator. This further improves efficiency of the unit because the coolant 14 and oil both leave the cooling radiator 10 at the point where both the oil and water are at their lowest temperature.

Figure 6:
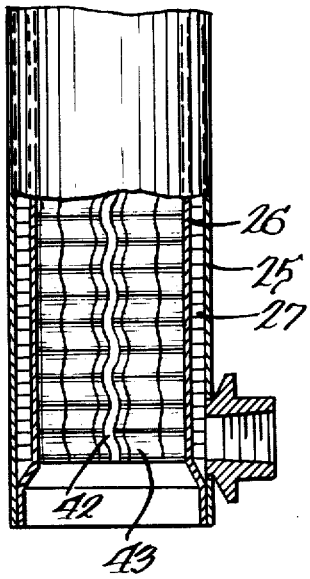
FIG. 6 is a view similar to the lower end of the heat exchanger of FIG. 2 but illustrating another embodiment of the invention.
Figure 7:
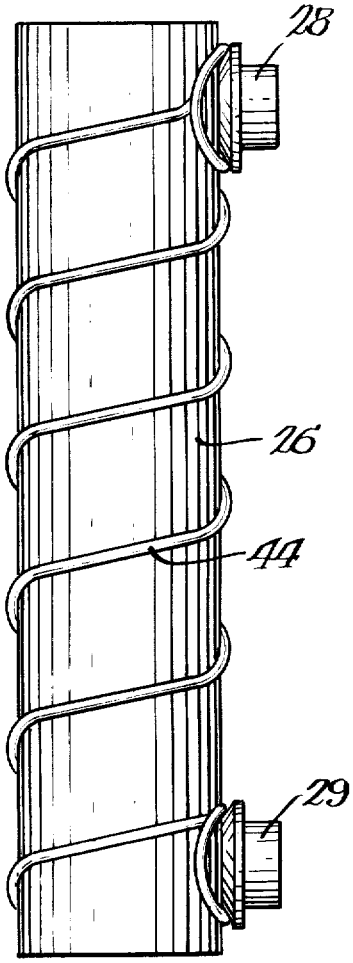
FIG. 7 is an elevational view of the inner tube only of a further embodiment of a heat exchanger illustrating a helical wire turbulator.

The embodiment illustrated in FIG. 6 is similar to the first embodiment but in FIG. 6 the tips 42 of the fin 43 are shaped to an undulating wave that can be seen at the bottom of FIG. 6. In the embodiment of FIG. 7, there is provided a helical wire turbulator 44 around the inner cylinder 26 and extending between the inlet fitting 28 and the outlet fitting 29. This turbulator 44 would therefore be located within the oil space 27 and would further add to heat transfer efficiency by causing turbulent flow of oil within this space.

We claim:

1. A cooling radiator having secondary cooling means comprising:

a pair of spaced liquid coolant tanks, one of which is an inlet tank having a liquid coolant inlet adjacent one end and the other of which is a liquid outlet tank having an outlet adjacent its corresponding opposite end;

interconnecting spaced coolant tubes between said tanks for flow of liquid coolant between the tanks by way of said tubes;

a heat exchanger for cooling a second liquid located in heat exchange relationship with said outlet tank, said heat exchanger having spaced inlet and outlet, a confined liquid space therebetween for flow of a liquid through the space in heat exchange relationship with the liquid coolant in said outlet tank, said heat exchanger comprising substantially concentric tubes spaced apart to provide a confined liquid space; and an internal fin within said heat exchanger located within an inner tube in heat exchange relationship with the liquid in said outlet tank, said heat exchanger internal fin comprising a sheet metal heat conducting member having spaced sides arranged in a star shape with the star tips bearing against the inner surface of the inner tube and said tips comprising the outer extremities of spaced fingers comprising said star, the sides of said fingers having apertured flutes for creating turbulence in the liquid coolant flowing through said inner tube, over the inner and outer surfaces of said sheet metal and through said fluted apertures.

2. A cooling radiator having secondary cooling means comprising:

a pair of spaced liquid coolant tanks, one of which is an inlet tank having a liquid coolant inlet adjacent one end and the other of which is a liquid outlet tank having an outlet adjacent its corresponding opposite end;

interconnecting spaced coolant tubes between said tanks for flow of liquid coolant between the tanks by way of said tubes;

a heat exchanger for cooling a second liquid located in heat exchange relationship with said outlet tank, said heat exchanger having spaced inlet and outlet, a confined liquid space therebetween for flow of a liquid through the space in heat exchange relationship with the liquid coolant in said outlet tank, said heat exchanger comprising substantially concentric tubes spaced apart to provide a confined liquid space; and an internal fin within said heat exchanger located within an inner tube in heat exchange relationship with the liquid in said outlet tank, said heat exchanger internal fin comprising a sheet metal heat conducting member having spaced sides arranged in a star shape with the star tips bearing against the inner surface of the inner tube, said tips comprise the outer extremities of spaced fingers comprising said star, the sides of said fingers having apertured flutes for creating turbulence in the liquid coolant flowing through said inner tube, over the inner and outer surfaces of said sheet metal and through said fluted apertures, and wherein said space between said inner and outer tubes is provided with a helical wire turbulator extending between the inlet and outlet to said space.

* * * * *